United States Patent [19]

Roberts et al.

[11] 4,339,041

[45] Jul. 13, 1982

[54] COMPOSITE PACKAGING SYSTEM INCLUDING AN OUTER PARALLELOGRAM CONTAINER ADAPTED TO HOLD A PLURALITY OF WEDGE SHAPED INNER CARTONS

[75] Inventors: Harry H. Roberts, Roswell, Ga.; Raymond A. Cote, Taylorsville, N.C.

[73] Assignee: Champion International Corporation, Stamford, Conn.

[21] Appl. No.: 179,109

[22] Filed: Aug. 18, 1980

Related U.S. Application Data

[63] Continuation-in-part of Ser. No. 161,027, Jun. 19, 1980, Pat. No. 4,313,542, which is a continuation-in-part of Ser. No. 57,164, Jul. 13, 1979, abandoned.

[51] Int. Cl.[3] ..... B65D 5/54

[52] U.S. Cl. ..... 206/611; 206/45.32; 206/551; 206/822; 229/22

[58] Field of Search ..... 229/22, 36, 16 R; 206/611, 551, 45.32, 436, 822; 220/DIG. 13

[56] References Cited

U.S. PATENT DOCUMENTS

| | | | |
|---|---|---|---|
| 1,912,329 | 5/1933 | Wassell | 229/22 |
| 1,933,643 | 11/1933 | Tanner | 229/22 |
| 2,447,563 | 8/1948 | Buttery | 229/36 |
| 2,902,200 | 9/1959 | Manners | 229/36 |
| 2,947,637 | 8/1960 | Fobiano | 229/22 |
| 3,222,190 | 12/1965 | Davis | 229/22 |
| 3,263,899 | 8/1966 | Collura et al. | 206/611 |
| 3,726,468 | 4/1973 | Muth | 229/36 |
| 3,786,983 | 1/1974 | Hennessey | 229/36 |

*Primary Examiner*—Stephen P. Garbe
*Attorney, Agent, or Firm*—Evelyn M. Sommer

[57] ABSTRACT

A composite packaging system is disclosed including a plurality of inner wedge shaped cartons each having a slanted rear wall thereby conforming to the configuration of a piece of pie. An outer carton is disclosed, having a generally parallelogram configuration in plan, which is adapted to hold an even number of inner wedge shaped cartons. The unique configuration of the outer carton permits the loading of the inner wedge shaped cartons therein in an array such that each panel of the inner wedge shaped cartons is in abutting relationship with either a wall of the outer carton or with a panel of an adjacent wedge shaped carton. By this arrangement, the inner cartons are prevented from shifting within the outer carton thereby preventing damage thereto. The configuration of the outer carton further functions to space the slanted end wall of each wedge shaped carton away from the side wall of the outer carton, thereby providing a cushioned space for maintaining the crust of the pies stored within the wedge shaped cartons in an undamaged condition.

9 Claims, 14 Drawing Figures

COMPOSITE PACKAGING SYSTEM INCLUDING AN OUTER PARALLELOGRAM CONTAINER ADAPTED TO HOLD A PLURALITY OF WEDGE SHAPED INNER CARTONS

The subject application is a continuation in part of copending U.S. application Ser. No. 161,027, filed June 19, 1980, now U.S. Pat. No. 4,313,542, which is in turn a continuation-in-part of prior application Ser. No. 057,164, filed July 13, 1979, now abandoned.

BACKGROUND OF THE INVENTION

This invention relates to an improved carton for packaging single servings of pie, and more specifically to a carton of this type which is attractive in appearance and provides adequate protection for its contents.

The subject invention further relates to an improved outer parallelogram carton for holding a plurality of individual pie shaped cartons.

U.S. Pat. No. 3,876,131 and U.S. Pat. No. Re. 29,185, disclose triangularly-shaped cartons useful for packaging triangularly-shaped food products, such as slices of pizza. The cartons were adapted to hold the product during storage and heating. Heating by microwave oven was facilitated by openings which permitted circulation of air through the carton during the heating process, but which could be sealed prior to use. The openings were preferably made in the bottom panel and in the adjoining end wall panel, and were normally covered by a removable strip of film to protect the product from contamination during storage. These disclosures did not identify structural design features necessary to accommodate a single-serving slice of pie of the dessert-type which typically has a thin outer shell of a baked pastry crust and contains a filling of fruit or the like.

Dessert-type pies must be carefully protected from breakage, as well as drying out and contamination. Pies of this type are typically cut into single, wedge-shaped portions. The apex of this wedge is particularly fragile and is easily breakable. Similarly, the area of crust which extends around the base of the wedge is also easily broken. While the prior art has developed wedge-shaped cartons, there is no known paperboard carton adapted to package a dessert-type pie in single-serving, wedge-shaped portions and afford a degree of protection to the pie satisfactory for normal abuse during shipping and handling. Dessert-type pies need special protection if they are to survive shipment and handling so that they remain attractive in appearance when finally served.

Another shortcoming of a triangularly shaped food carton is that it can not be easily stored on a shelf or in a freezer since its unusual shape tends to take up more space than necessary. Also because of their shape, the individual triangular cartons are difficult to stack or pack and thus are prone to damage.

SUMMARY OF THE INVENTION

It is an object of the present invention to provide a carton especially adapted for packaging single-serving portions of pie.

It is a more specific object of the present invention to provide a carton especially adapted for packaging single-serving portions of a dessert-type pie which will provide adequate protection to the pie so that it remains appetizingly attractive.

It is yet another and more specific object of the present invention to provide a carton especially adapted for storing single-serving portions of pie and protecting its attractive appearance while permitting viewing of the contents of the carton.

It is yet another and still more specific object of the present invention to provide a carton having an easily-opened, tear-off top for storing a single-serving portion of a dessert-type pie with adequate protection for the pie to maintain its attractive appearance.

It is still a further object of the subject invention to provide a unique outer carton, having a parallelogram configuration, for holding a plurality of single serving triangular cartons in an attractive, easily stored manner.

It is still another object of the subject invention to provide an outer parallelogram carton for securely holding a plurality of single serving triangular cartons, and permitting viewing of at least one of the inner triangular cartons.

These and other objects are accomplished according to the present invention which provides an improved carton for use in containing a wedge-shaped piece of pie and a blank for forming a carton of this type. The carton comprises: a triangular bottom panel having a base edge and converging side edges; a trapezoidal end wall hingedly connected to the base edge of said bottom panel and extending upwardly therefrom to a top edge, wherein the top edge is longer than said base edge; a triangular top panel hingedly connected to said end wall along said top edge, said top panel being substantially identical in shape to said bottom panel but longer from the apex to said top edge than the distance from the apex to said base edge of said bottom panel, and extending parallel to said bottom panel; inner side wall panels secured to the converging edges of said bottom panel and extending upwardly therefrom; outer side wall panels secured to the converging edges of said top panel and extending downwardly therefrom and outwardly of said inner side wall panels; corner flaps connecting the converging ends of said inner side walls and connecting the ends of said end wall to said inner side walls; and means securing said inner and outer side wall panels in face contact.

The subject invention further includes a unique outer parallelogram carton and a blank for forming same which is adapted to hold an even number of wedge shaped cartons. The tubular outer carton includes top and bottom panels which have a generally parallelogram configuration. The outer carton further includes an upstanding tubular side wall hingedly connected around the periphery of the top and bottom panels and extending therebetween. The unique parallelogram configuration of the carton permits a plurality of wedge shaped cartons to be securely held therein. More specifically, the wedge shaped cartons are disposed within the outer carton in an array such that the side edges of each are in abutting relastionship with either another wedge shaped carton or the side wall of the outer carton. By this arrangement, the inner wedge shape cartons are securely held and are prevented from shifting within the outer carton thereby protecting the delicate contents therein. A tear strip may be provided in the side wall of the carton to facilitate the removal of individual pie pieces. In a preferred embodiment of the subject invention, a triangular window is provided in the top panel of the outer carton to permit viewing of the contents therein.

BRIEF DESCRIPTION OF THE DRAWINGS

The invention will become better understood from the following detailed description, especially when read in light of the attached drawings, wherein.

DETAILED DESCRIPTION OF THE INVENTION

Figure 1:
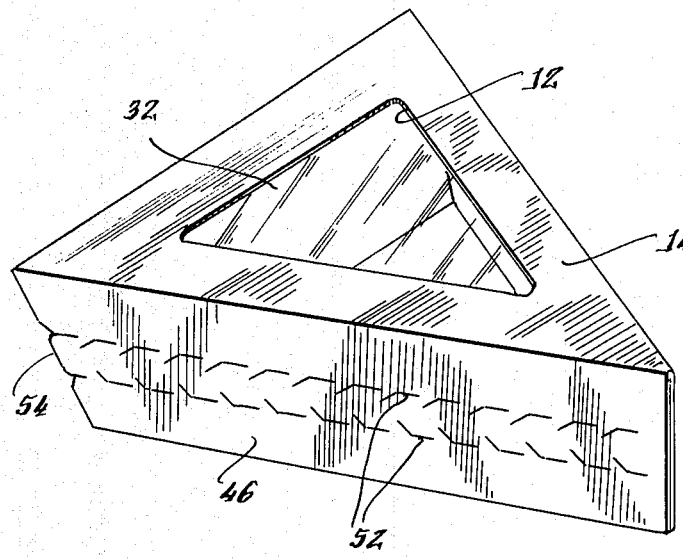
FIG. 1 is a perspective view of a preferred embodiment of a carton according to the present invention.
Figure 5:
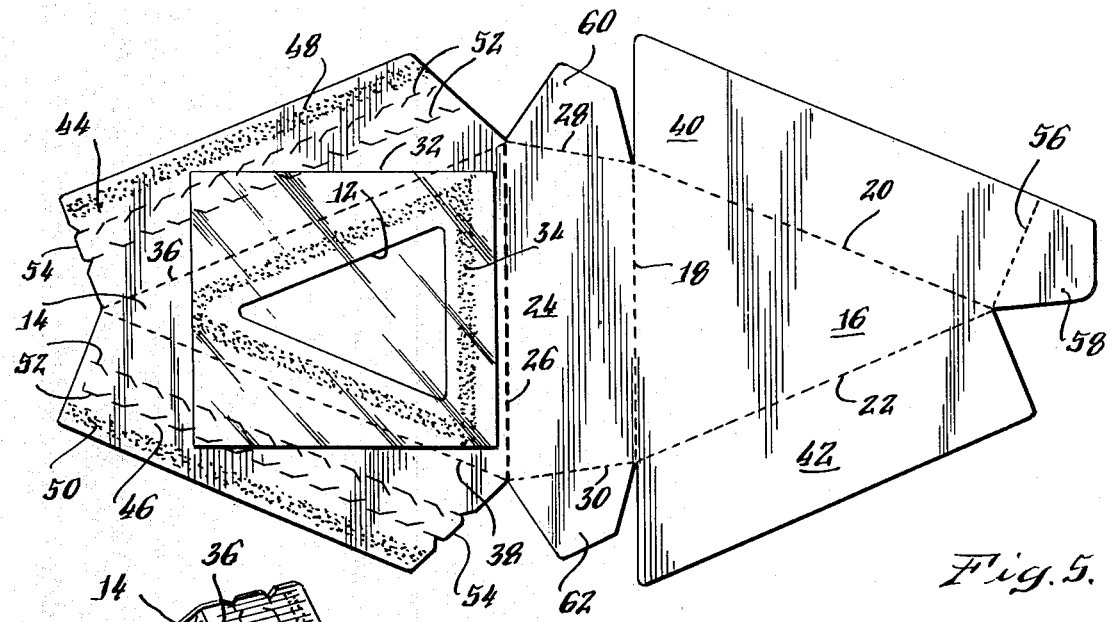
FIG. 5 is a diagrammatic view of a carton blank from which a carton as shown in FIG. 1 can be formed, the blank being viewed from what will be the inside surface of the carton.
Figure 8:
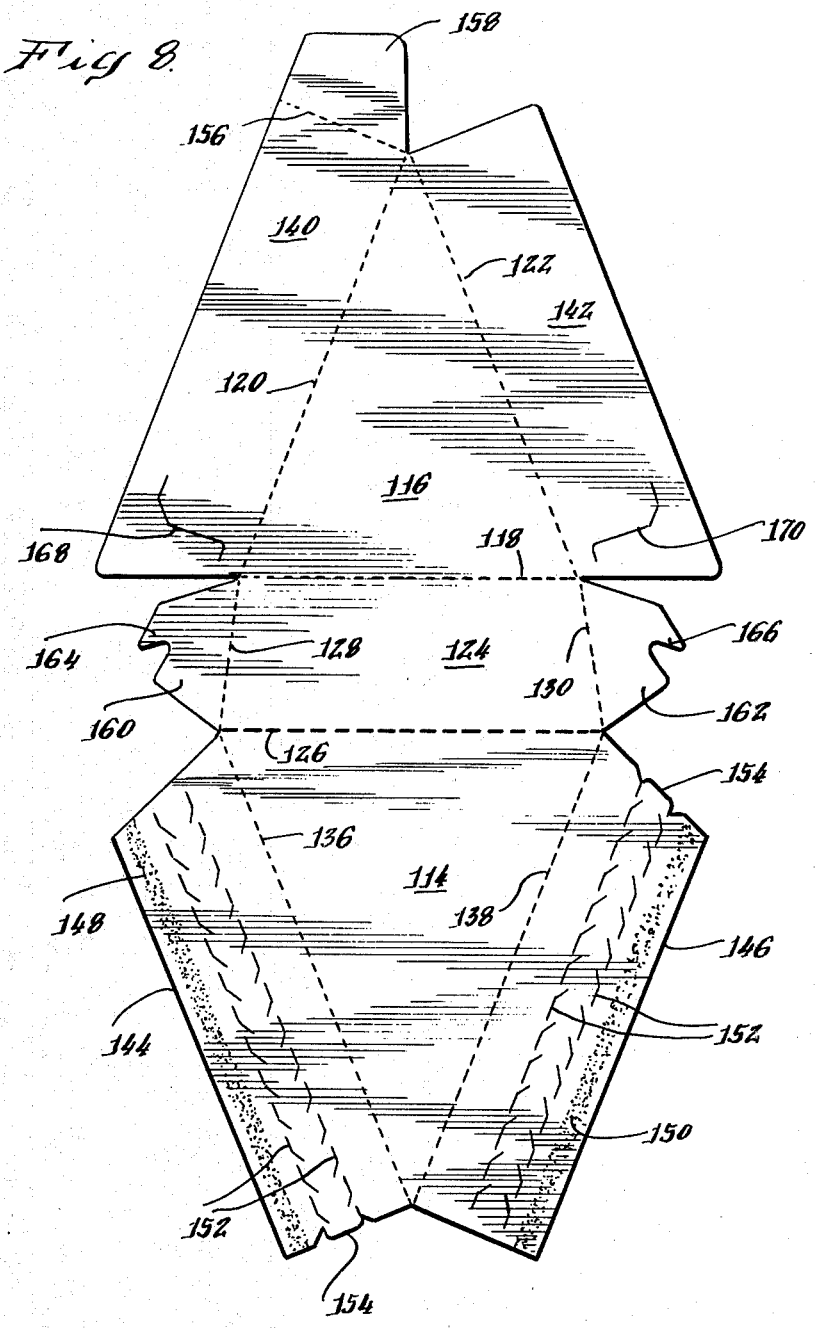
FIG. 8 is a diagrammatic view of a carton blank for forming an alternative form of carton, also viewed from what will be the inside surface of the carton.

The inner carton provided by the present invention is generally of triangular shape and has a suitable design for providing an adequate degree of protection to a piece of dessert pie placed therein to protect it from damage during shipment and handling. The preferred form of the carton generally designated 10 in FIG. 1 will have a window 12 for viewing the contents of the carton and will have an easily removable top 14. The blank for forming the carton shown in FIG. 1 is shown in FIG. 5. An alternative form of blank for forming a carton having a closed top panel is shown in FIG. 8.

Figure 3:
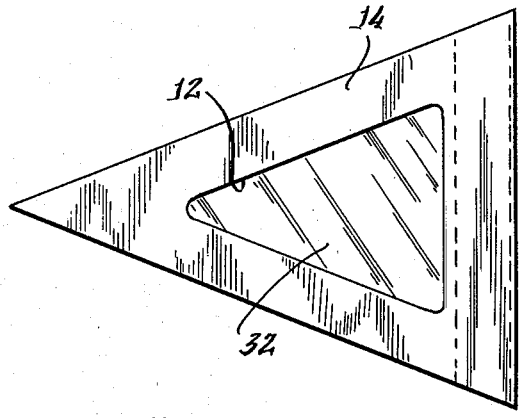
FIG. 3 is a top plan view of the carton as shown in FIG. 1.
Figure 2:
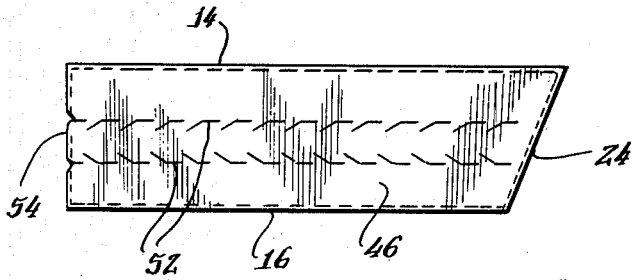
FIG. 2 is a side elevational view of the carton shown in FIG. 1.
Figure 4:
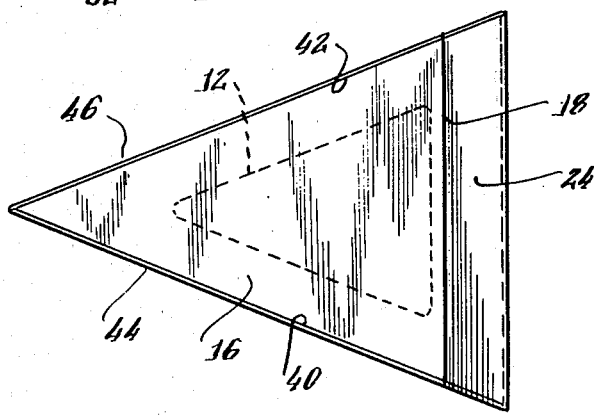
FIG. 4 is a bottom plan view of the carton as shown in FIG. 1.
Figure 6:
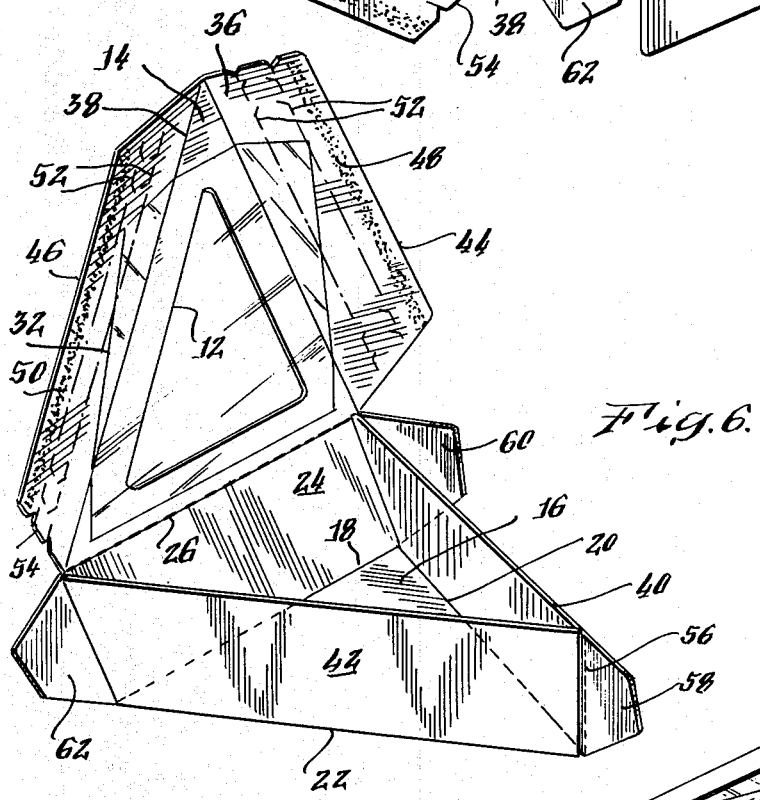
FIG. 6 is a perspective view showing an initial stage of assembly of the carton as shown in FIG. 1.
Figure 7:
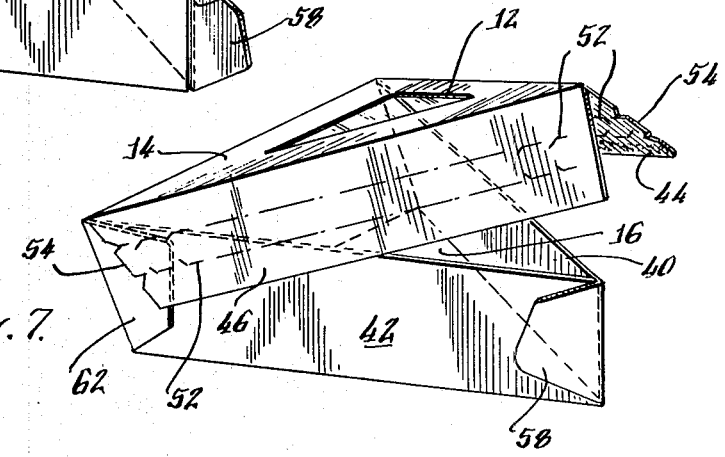
FIG. 7 shows a final stage of assembly of the carton as shown in FIG. 1.

Reference is now made to FIG. 5 which shows a blank for forming a carton according to the present invention as shown in FIG. 1. This carton is shown in FIGS. 2 through 4 when viewed from various directions. Also shown are successive stages of construction in FIGS. 6 and 7. The blank shown in FIG. 5 is viewed from what will be the inside of the carton. The blank is shown to have a triangular bottom panel 16 having a base edge 18 and converging side edges 20 and 22. A trapezoidal end wall 24 is hingedly connected to the base edge 18 of the bottom panel 16. The end wall 24 has a top edge 26 which is longer than the base edge 18. The end wall 24 also has side edges 28 and 30.

Hingedly connected to the top edge 26 of the end wall panel 24 is top panel 14 having window opening 12 therein. The window 12 can be covered with a suitable film material shown as 32 which is preferably applied in strip form and secured to the top panel 14 by means of glue applied as indicated at 34. The film 32 can be any of those materials known to be suitable. The top panel 14 is substantially identical in shape to the bottom panel 16 but is longer from the apex of the triangle where side edges 36 and 38 converge, to the top edge 26 than the distance from the apex formed by bottom panel side edges 20 and 22 to the base edge 18 of the bottom panel 16.

By dimensioning the top panel 14, the bottom panel 16 and the end wall panel 24 as described, the end wall panel 24 will slant outwardly from base edge 18 up toward top edge 26 as can be clearly seen in FIG. 2. This outwardly slanting end wall panel 24 closely conforms to the shape of a pie crust and thereby increases the support for the crust and decreases and likelihood of damage to this portion of a pie.

Inner side wall panels 40 and 42 are connected to bottom panel 16 along side edges 20 and 22, respectively. It can be seen in FIG. 6, for example, that the side wall panels 40 and 42 are folded upwardly about fold lines at side edges 20 and 22 to form vertically upright side wall panels. In the first carton, these side walls 40 and 42 are on the interior of the carton and are overlapped and sealed to outer side wall panels 44 and 46. It can also be seen in FIG. 6 or FIG. 7 that outer side wall panels 44 and 46 are bendably attached to side wall panel 14 about fold lines at the side edges 36 and 38. It is preferable to secure the outer side wall panels 44 and 46 to the inner side wall panels 40 and 42 by suitable means such as glue positioned at areas 48 and 50. Alternatively, the inner and outer side wall panels can be secured by a "Lock-Heat" seal process wherein the paperstock from which the blank is formed is provided with a coating of polyethylene thereon and a jet of superheated air is directed onto the inner and outer side wall panels during the erection process in order to melt the polyethylene coating on such panels to produce a bond therebetween.

It can be seen that both side wall panels 44 and 46 have intermitted cut lines 52 extending along their lengths parallel to side edges 36 and 38. By providing a pair of intermitted cut lines 52 in this or similar manner, which terminate in tabs shown as 54, tear strips are provided for easily opening the carton. By pulling on tabs 54, the entire strip of material between the intermittent cut lines 52 is removed and the top panel 14 can be lifted upward. By providing an intermittent score line at top edge 26, it is possible to remove the entire top of the container very simply.

In some situations, it is desired to warm the pie in a microwave oven. This may be to defrost a totally frozen pie or to simply heat an ambient temperature or conventionally-refrigerated pie to bring it to a moderately warmed condition. The carton of the present invention is particularly well suited for heating in this manner without opening the carton. If it is desired, however, the film strip 32 can be removed from the opening 12 in the top panel 14 to permit escape of moisture generated during more prolonged heating in a microwave oven. Further, the entire lid can be removed to serve the same purpose.

Attached to edge 56 of inner side wall panel 40, is a corner flap 58. Corner flap 58 is preferably attached to the outside of inner side wall panel 42 either by gluing or the Lock-Heat process previously described. By securing corner flap 58 to the outside of inner wall member 42, a sturdier joint is formed between the converging ends of inner side wall members 40 and 42. This fold around flap 58 provides improved protection to the pointed edge of the individual serving of pie positioned within the container. The flap 58 may also be attached by either method mentioned above to the inner surface of inner side wall panel 42. Alternately, the flap 58 may simply fold into overlapping relationship to inner side wall panel 42, without attachment thereto, in which case the flap 58 is held in place by outer side wall panel 46 when the carton is closed.

Corner flaps 60 and 62 are provided along edges 28 and 30 of the end wall panel 24. As shown in detail in FIGS. 6 and 7, these corner flaps 60 and 62 are bent into contact with the outside surface of inner side wall panels 40 and 42, respectively. As with the corner flap 58, corner flaps 60 and 62 can be secured by means of gluing or the like.

As pointed out above, outer side wall panels 44 and 46 are secured to the outer surfaces of inner side wall panels 40 and 42 by suitable means. As discussed above, this means may comprise areas of glue applied at areas 58 and 50. By positioning the glue areas 48 and 50 in this manner, they are below the tear strips defined by tabs 54 and paired intermittent cut lines 52 which appear on both outer side wall panels 44 and 46.

The carton, according to the present invention, will preferably be made of a paperboard material and most preferably will contain a layer of a plastic or wax material adhered thereto to provide a moisture barrier. Virtually all paperboard materials have a grain which is caused by the method of manufacturing. It is preferred to have this grain run along the longitudinal axis of the blank. Thus, the grain will run parallel to a line which passes through the apexes of the top and bottom triangular panels 14 and 16 where their respective side wall edges converge. It is preferred to have the grain run in this direction because the tear strips defined by tab 54 and intermittent cut lines 52 will more easily be removed by pulling where they run substantially parallel to the grain, moreover such grain direction provides the end panel with greater stacking strength.

It will be seen from the figures that the inner and outside wall members are positioned perpendicularly to the plane of the top panel 14 and the bottom panel 16 which are essentially parallel to each other. Forming the carton in this manner provides a desirable degree of strength and facilitates sealing of the inner surface of the outer side wall panels to the outer surface of the inner side wall panels.

Referring to the alternative embodiment for the blank as shown in FIG. 8, the last two digits of like parts to those shown in the other figures are the same as those parts, while all parts in this figure are given numbers greater than 100. In FIG. 8, the top wall panel 114 is constructed without a window for viewing the contents of the package. Attached to end wall panel 124 at end wall edges 128 and 130 are corner flaps 160 and 162. These corner flaps have male locking tabs 164 and 166 at the ends thereof which mate with female slots 168 and 170 in inner side wall numbers 140 and 142, respectively.

Figure 9:
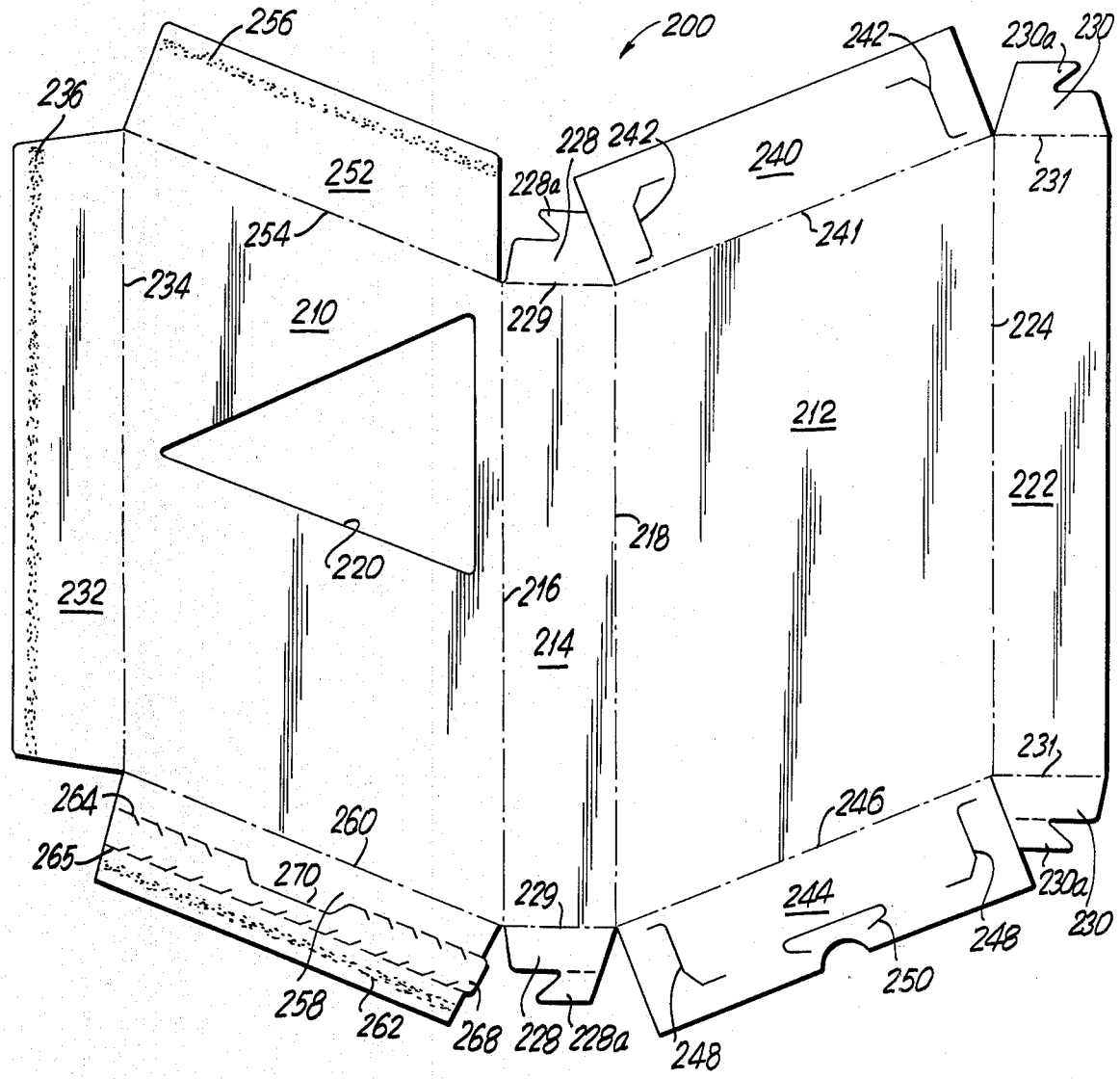
FIG. 9 is a plan view of a blank for forming the new and improved outer parallelogram carton of the subject invention.

Referring now to FIG. 9, the blank 200 for forming the outer carton 202 of the composite packaging system of the subject invention is illustrated. The blank 200, is adapted to be folded into a carton having a generally parallelogram configuration in plan for securely holding a plurality of wedge shaped cartons 10 or 100 therein. The blank 200 includes top and bottom panels 210 and 212, which have a parallelogram configuration, and are disposed in a spaced apart, essentially mirror image relationship. A first side panel 214 is disposed between and hingedly connected to top and bottom panels 210 and 212 along fold lines 216 and 218 respectively. Top panel 210 may be provided with a generally triangularly shaped aperture 220 to permit viewing of a wedge shaped carton, within the outer carton 202, as more fully described hereinafter.

A second inner side panel 222 is hingedly connected to the opposed edge of bottom panel 212 along fold line 224. Both first and second side panels 214 and 222 include a pair of corner flaps 228, 230 respectively, which are hingedly connected, thereto, along the opposed edges thereof, along fold lines 229 and 231. Each cover flap 228, 230 is provided with an angled tab **228*a*, 230*a* respectively which are utilized during an intermediate folding stage of the blank 200 prior to the insertion of the wedge shaped cartons 100. A third outer side panel 232 is hingedly connected to top panel 210 along fold line 234 and cooperates with second inner side panel 224 to form a double ply side panel in the erected carton 202. Preferably, third side panel 232 is provided with a glue strip 236 as illustrated in FIG. 9**.

Four end panels are hingedly connected to the remaining free edges of the top and bottom panels. More specifically, a first inner end panel 240 is hingedly connected to bottom panel 212 along fold line 241. First inner end panel 240 includes a pair of opposed cut lines 242 defining apertures for receiving the adjacent angled tabs **228*a* and 230*a* of the associated corner flaps during the erection of the carton. Similarly, second inner end panel 244 which is hingedly connected to the opposed edge of bottom panel 212 along fold line 246 includes cut lines 248 for receiving the adjacent tabs 228*a* and 230*a*. Preferably, second inner end panel 244 further includes a central cut line 250** defining an aperture adapted to receive a locking tab for reclosing the carton, as will become later apparent.

A first outer end panel 252 is hingedly connected to top panel 210 along fold line 254 and includes an adhesive strip 256. Second outer end panel 258 is hingedly connected to the opposed edge of top panel 210 along fold line 260 and also includes an adhesive strip 262. In the erected carton 202, outer end panels 252 and 258 overlap and are adhesively connected to inner end panels 240 and 244 respectively to define double ply end walls. Second outer end panel 258 is further provided with a pair of spaced apart intermittent cut lines 264, 265, which define tear strip 268 to facilitate the opening of the outer carton 202. Cut line 265 further functions to define locking tab 270 which is receivable within the aperture defined by cut line 250 formed in second inner end panel 244 for reclosing the carton, as more fully described hereinafter.

The size, shape and relative angles of the various panels of blank 200 are arranged such that an even number of wedge shaped cartons 100 will fit inside and be securely held within the confines of outer carton 202.

Figure 14:
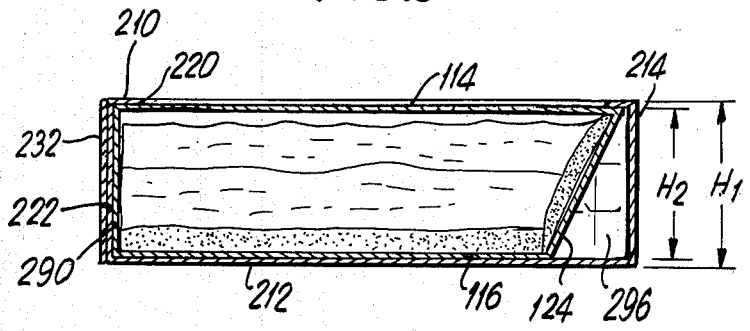
FIG. 14 is a cross sectional view of the composite packaging system of the subject invention taken along the line 14—14 in FIG. 12.
Figure 10:
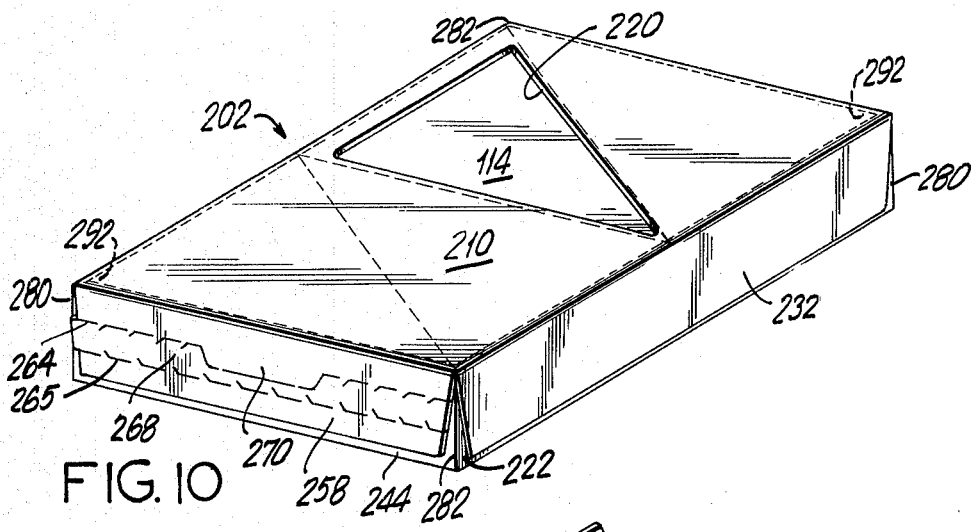
FIG. 10 is a perspective view of the composite packaging system of the subject invention illustrating the location of the wedge shaped cartons within the unique outer parallelogram carton.
Figure 11:
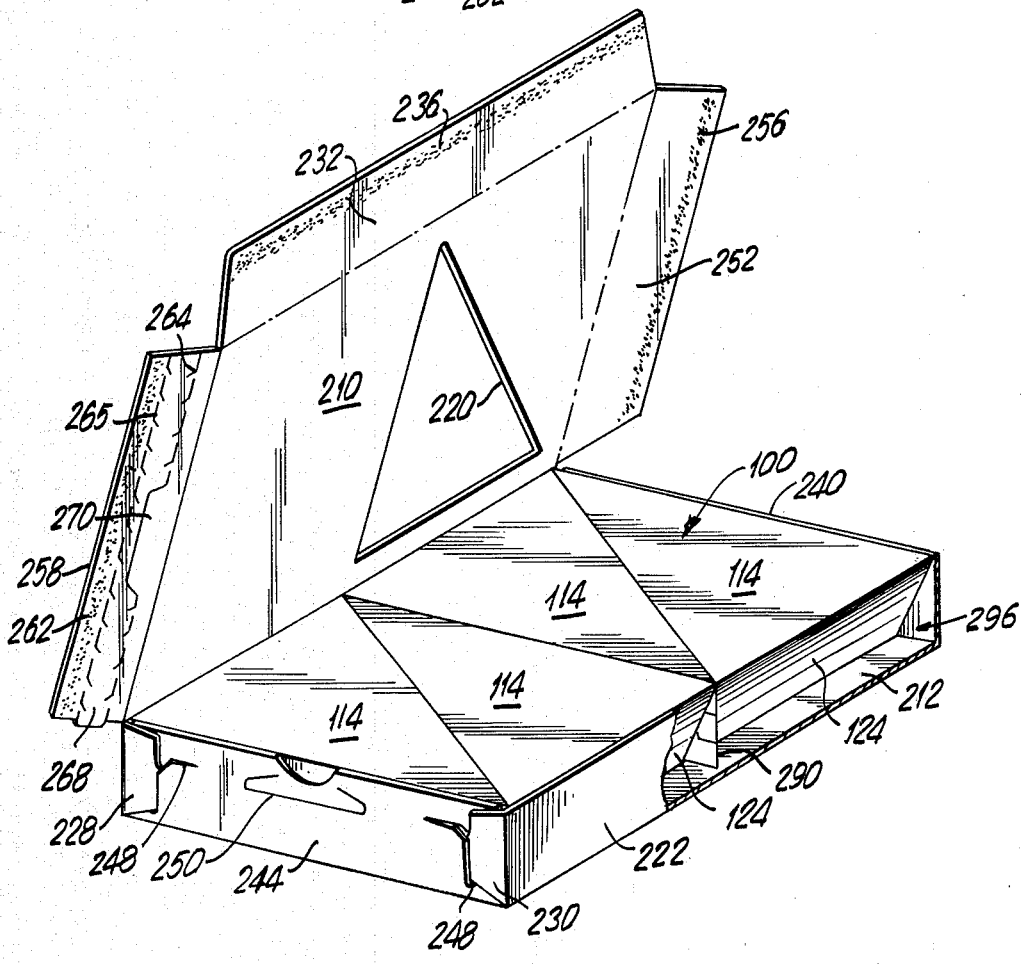
FIG. 11 is a perspective view, partially cut away, of the composite packaging system of the subject invention illustrating the wedge shaped cartons loaded into an open outer parallelogram carton.

As illustrated in FIGS. 10, 11 and 14, the resulting outer carton 202 provides a configuration wherein the top and bottom panels 210, 212 are disposed in parallel relationship, while the tubular side wall (defined by the side and end panels) extends therebetween and perpendicular thereto thereby providing a sturdy composite packaging system. As most clearly seen in FIG. 12, the subject carton has a unique parallelogram configuration in plan that permits the sturdy and secure holding of a plurality of wedge shaped cartons therein which prevents slippage within the outer carton thereby reducing the likelihood of damage to the contents thereof.

To erect blank 200 into the parallelogram outer carton 202 of the composite packaging system of the subject invention, initially the bottom panel 212 and the adjacent side and end wall panels are folded into a tray-like configuration in preparation for the loading of a plurality of wedge shaped cartons therein. More specifically, and as illustrated in FIG. 11, first and second inner end panels 240 and 244 are folded upwardly about fold lines 241 and 246 respectively. Thereafter, first and second side panels 214 and 222 are also folded upwardly about fold lines 218 and 224 into perpendicular relationship with bottom panel 212 to form an open tray-like configuration. In order to maintain the outer carton 202 in this intermediate configuration, corner tabs 228 and 230 are rotated about their respective fold lines such that the associated angled tabs 228*a* and 230*a* may be interengaged with the adjacent apertures defined by cut lines 242 and 248. Preferably these initial folding steps are carried out on automatic machinery at high speed.

Thereafter, and as more fully described immediately hereinbelow, a plurality of wedge shaped cartons are loaded within the outer carton 202. While the Figures illustrate the loading of wedge shaped cartons 100 corresponding to the second embodiment thereof, it is intended of course that wedge shaped cartons 10 which include a viewing window 12, may be similarly utilized.

After the loading of an even number of wedge shaped cartons, the outer carton 202 is sealed to form the composite packaging system of the subject invention by folding top panel 210 into abutting relationship with the top panels 114 of the wedge shaped cartons 100 and thereafter downwardly folding and adhesively connecting the remaining side and end panels. More specifically, and as illustrated in FIG. 10, third side panel 232 is folded into coplanar, abutting relationship with second side panel 222 and is adhesively connected thereto. Similarly, first and second outer end panels 252 and 258 folded into coplanar, abutting relationship with inner end panels 240 and 244 respectively, and are adhesively connected thereto, thereby forming the unique composite packaging system of the subject invention.

Figure 12:
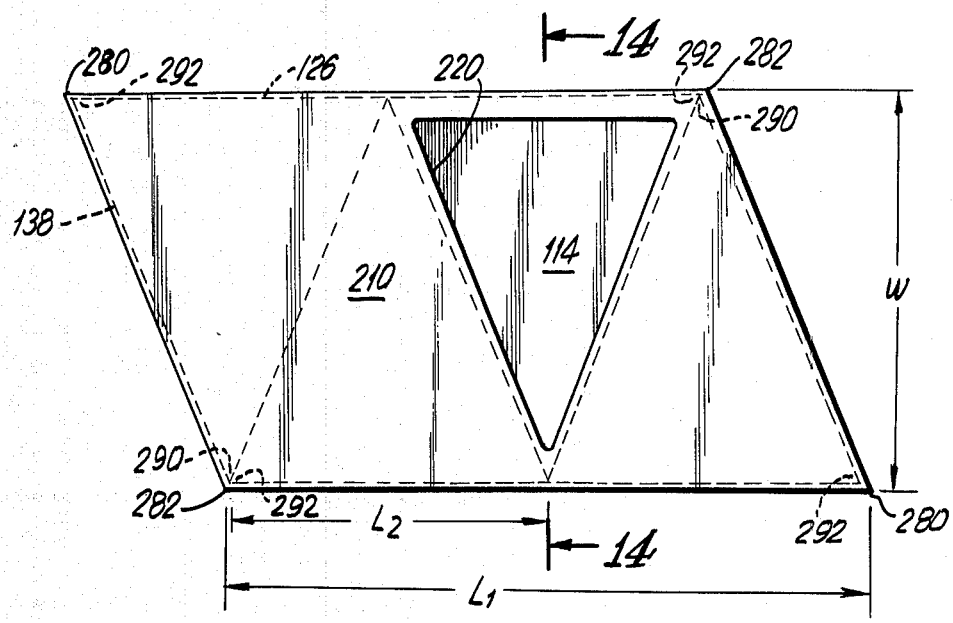
FIG. 12 is a top plan view of the composite packaging system of the subject invention illustrating the unique parallelogram configuration.

As pointed out above, the shape, size and angles of the outer carton 202 permits the secure packaging of an even number of inner wedge shaped cartons 100. More specifically, and as illustrated in FIG. 12, the parallelogram configuration of the top and bottom panels 210, 212, in cooperation with the tubular side wall of the outer carton functions to define two pairs of opposed corner portions 280 and 282. Opposed corner portions 280 are defined by an acute angle which substantially corresponds to the included angle defined by the base edge 126 and a side edge 138 of a wedge shaped carton 100. (shown in phantom). As illustrated in FIG. 12, each corner portion 282 of the second pair is defined by an obtuse angle which is equal to the sum of two angles. More specifically, each obtuse corner portion 282 corresponds to the sum of the included angle between a base edge 126 and side edge 136 of a wedge shaped carton 100, and in addition, the included angle between the two side edges 138 and 136 of another wedge shaped carton 100. Thus, each obtuse corner portion 282 is adapted to securely receive and contain the apex portion 290 of one wedge shaped carton as well as a base corner portion 292 of another wedge shaped carton.

In accordance with the subject invention, the width w of outer carton 202, measured along an imaginary line perpendicular to the opposed side wall panels 214 and 212 is substantially equal to the length of a single wedge shaped carton 100 measured along a line perpendicular to a base edge 126 of top panel 114 and intersecting the opposed apex 290 thereof. The length $L_1$ of each side edge 214, 224 of the outer carton 202 is substantially equal to the sum of the lengths $L_2$ of the base edges 126 of each wedge shaped carton held therein divided by two. For example, and as illustrated in FIG. 12, if four wedge shaped cartons 100 are to be held within the outer carton 202, the length $L_1$ thereof is substantially equivalent to the sum of four lengths $L_2$ of the base edges 126 of the inner cartons 100 divided by two (which corresponds to the sum of lengths $L_2$ of two base edges).

In accordance with the subject invention, the height $H_1$, (as illustrated in FIG. 14) of outer carton 202 is substantially equal to the height $H_2$ of an inner wedge shaped carton 100 such that the top and bottom panels of the latter are in contiguous and abutting relationship with the top and bottom panels of the outer carton 202.

The wedge shaped cartons 100 are loaded within outer carton 202, in an alternating array such that the relative shifting of the inner cartons 100 within the outer carton 202 is substantially inhibited. More specifically, wedge shaped cartons 100 are loaded into outer carton 202 (while it is in the intermediate tray-like configuration of FIG. 11) with the base edge 126 of each top panel 114 being in abutting relationship with either the first of second side panels 214 or 222. Each adjacent wedge shaped carton 100 is oriented in an opposite direction such that the adjacent contiguous side edges 144, 146 thereof are in coplanar abutting relationship. In accordance with the subject invention, and as illustrated in FIGS. 10 and 12, the two outermost wedge shaped cartons 100, which are disposed adjacent the inner end panels 240, 244 are arranged such that a base corner portion 292 thereof (defined by the juncture between a base edge 126 and a side edge 138 of the top panel 114) coincides with the associated acute corner portion 280 of the outer carton 262. As noted above, the angle of the acute corner portion 280 is substantially equal to the angle of a base corner portion 292 of a wedge shaped carton such that a secure interfit is obtained therebetween. The above described alternating array also functions to locate an apex portion 290 of the outermost wedge shaped carton, as well as a base corner portion 292 of the adjacent wedge shaped carton in a tight interfitting relationship with each remaining obtuse corner portion 282. The parameters of the unique parallelogram outer carton 202 are regulated to accommodate an even number of inner wedge shaped cartons. The only variant is the length L1 of the outer carton which is dependent upon the number of inner wedge shaped cartons to be contained, and as noted above, corresponds to the sum of the lengths of the base edges 126 of the inner wedge shaped cartons divided by two.

As illustrated in FIGS. 11 and 14, the base edge 126 of top panel 114 of each wedge shaped carton 100 abuts one of the side wall panels of the outer carton 202 thereby preventing the shifting of the wedge shaped cartons. In contrast, the trapezoidal end walls 124, slope away and are spaced from the side wall panels thereby providing increased protection to the crust portion of the pies contained therein. More specifically, the space 296 functions essentially as a buffer area such that pressure exerted against the side wall panels is cushioned thereby ensuring that the crust is maintained in an attractive unbroken condition. As illustrated in FIG. 11, each apex portion 290 of the inner wedge shaped cartons abuts one of the side wall panels. This arrangement further inhibits the shifting of the wedge shaped cartons 100 within the outer carton. In addition, each upstanding apex portion 290 functions similar to an inner beam member thereby supporting the side wall panels. As is apparent from FIG. 1, due to the unique parallelogram configuration of the outer carton each of the side walls of the wedge shaped cartons are in a secure, contiguous abutting relationship with either an adjacent wedge shaped carton or the end walls of the outer carton such that the cartons are prevented from shifting during shipment and storage.

As illustrated in FIG. 10, the top panel 210 of the outer carton 202 may be provided with a substantially triangular aperture 220, having dimensions slightly less than a top panel 114 of a wedge shaped carton, and located in register with one of the wedge shaped cartons 100. By this arrangement, any graphics or indicia on the wedge shaped carton can be viewed from the exterior of the outer carton 202 thereby, for example, permitting identification of the type of pie piece held within.

Figure 13:
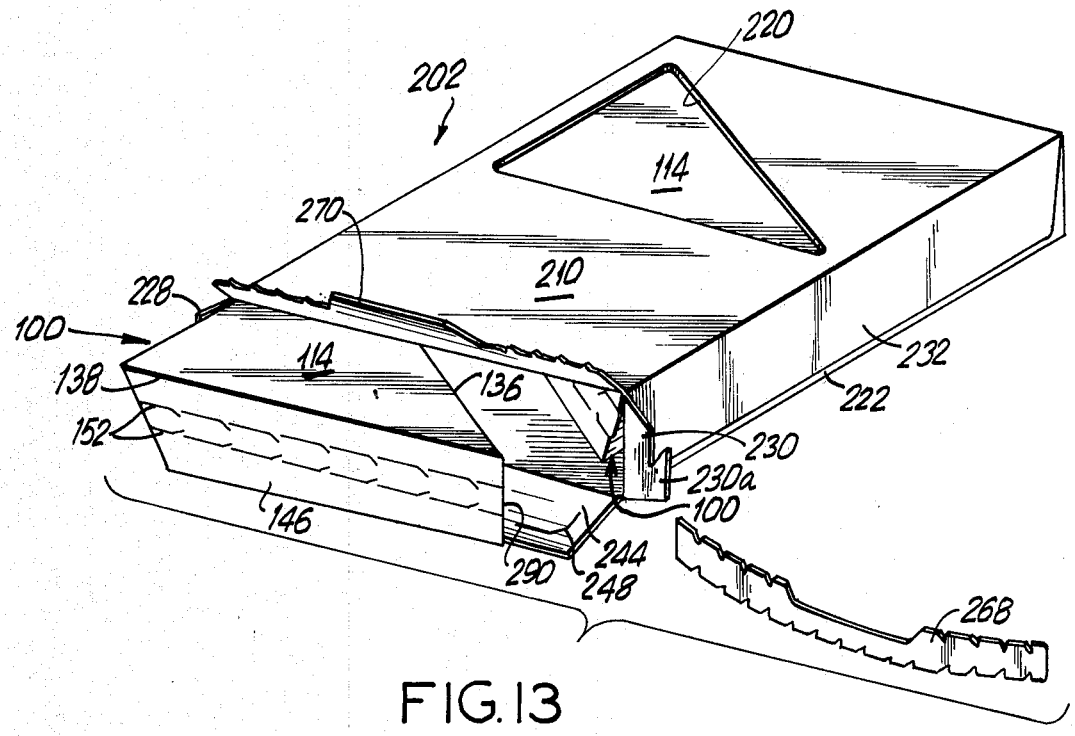
FIG. 13 is a perspective view, similar to FIG. 10, of the composite packaging system of the subject invention shown with the tear strip removed from the end panel and illustrating the partial withdrawal of one wedge shaped carton.

In order to open the outer carton 202 of the subject invention, to release a single wedge shaped carton 100, it is merely necessary to separate overlapping end panels 244 and 258 by removing tear strip 268, which is defined by spaced apart intermittent cut lines 264, 265 as described above. As illustrated in FIG. 13, after removing tear strip 268, end wall panels 244 and 258 can be separated to permit the removal of a single wedge shaped carton. To reclose outer carton 202, end panels 244 and 258 are folded into overlapping relationship such that locking tab 270 may be interengaged with the aperture defined by cut line 250.

In summary, there is provided a new and improved composite packaging system including a plurality of individual wedge shaped cartons adapted to hold a piece of pie and an outer parallelogram carton adapted to hold an even number of wedge shaped cartons. Each wedge shaped carton includes spaced apart triangular top and bottom panels with the top panel being of greater length thatn the bottom panel. A pair of side walls, extend between and are connected to the top and bottom panels and converge at an apex 290 at the tip of the carton. A trapezoidal end wall, connected between the top and bottom panels, is slanted such that the overall configuration of the wedge shaped carton substantially conforms to the configuration of a wedge shaped piece of pie. By this arrangement, the crust portion of the pie is protected from damage during shipment and storage.

The composite packaging system further includes an outer carton which has a generally parallelogram configuration in plan. The outer carton is adapted to hold an even number of wedge shaped cartons in abutting contact with the inner walls thereof such that the shifting of the inner wedge shaped cartons relative to the outer carton is minimized thereby further protecting the contents therein. In accordance with the subject invention, the slanted end walls of the wedge shaped cartons are spaced away from the side walls of the outer carton thereby providing additional protection to the crust portions of the pies. The parallelogram configuration of the outer carton allows the inner wedge shaped cartons to be loaded in an array which permits the side walls thereof to be in abutting contiguous relationship with other cartons or with the end walls of the outer carton.

The above description has been for the purpose of teaching those skilled in the art how to make and use the present invention and has not been for the purpose of reciting all those obvious modifications and variations of it which will become apparent upon a reading. It is intended, however, that all such obvious modifications and variations be included within the scope of the present invention which is defined by the following claims.

What is claimed is:

1. A composite packaging system including a plurality of individual wedge shaped cartons each configured to hold a piece of pie, and an outer parallelogram carton adapted to hold an even number of wedge shaped cartons, said composite packaging system comprising:

at least two wedge shaped cartons, each wedge shaped carton being formed of a one piece foldable cardboard blank and having a slanted end wall, said carton thereby conforming to the configuration of, and useful for containing a wedge shaped piece of pie having a slanted crust portion, said wedge shaped carton including a triangular bottom panel having a base edge and two side edges;

a triangular top panel disposed in spaced, parallel relationship with said bottom panel and having a base edge and two side edges, with the length of the base edge of said top panel being greater than the length of the base edge of said bottom panel, and with the length of said top panel measured along an imaginary line extending perpendicularly from the associated base edge to the opposed apex thereof being greater than the length of said bottom panel measured along an imaginary line extending perpendicularly from the associated base edge to the opposed apex thereof;

a pair of side walls extending between the associated side edges of said top and bottom panels and disposed perpendicular thereto, each said side wall being formed of inner and outer side wall members, with the bottom edge of each said inner side wall member being hingedly connected to the associated side edge of said bottom panel, and with the top edge of each said outer side wall member being hingedly connected to the associated side edge of said top panel, and with each said outer side wall member overlying and being adhesively connected to the associated inner side wall member, and wherein each said outer side wall member further includes a pair of spaced, intermittent cut lines extending along the length thereof and defining a tear strip to permit easy opening of the carton;

a trapezoidal end wall having top, bottom and side edges, with said top edge of said end wall and said base edge of said top panel being hingedly connected and of equal length and with said bottom edge of said end wall and said base edge of said bottom panel being hingedly connected and of equal length, and with said side edges of said end wall being respectively connected to the adjacent side edges of said side walls, and with said end wall sloping outwardly away from the interior of said carton, from said bottom edge to said top edge, such that said carton conforms to the shape of said pie piece with said sloping end wall functioning to provide increased protection and support to the slanted crust portion thereof;

said packaging system further including a tubular outer carton having a general parallelogram configuration in plan, said outer carton including, top and bottom panels disposed in spaced apart parallel relationsip, each said top and bottom panels being substantially identical and having a parallelogram configuration; and an upstanding tubular side wall including alternately hingedly connected opposed side and end panels, said side wall being hingedly connected around the periphery of said top and bottom panels and extending therebetween, with said hinged connections forming said side wall defining first and second pairs of opposed corner portions, with each corner portion of said first pair being an acute angle, substantially equal to the included angle defined by a base edge and a side edge of the top panel of a wedge shaped carton, and with each corner portion of said second pair being at an obtuse angle substantially equal to the sum of two angles, the first of said two angles being said acute angle and the second of said two angles being the included angle defined by the side edges of a top panel of a wedge shaped carton, and with the length of each said side panel of said outer carton being substantially equal to the sum of the lengths of the base edges of each triangular top panel of the wedge shaped cartons, housed within said outer carton divided by two, with the width of said outer carton, measured along an imaginary line perpendicular to both said opposed side panels, being substantially equal to said length of a top panel of said wedge shaped carton, and with the height of said outer carton being substantially equal to the height of a wedge shaped carton, said wedge shaped cartons being disposed within said outer carton in an array wherein said base edges of said top panels are disposed in abutting relationship with one of said opposed side wall panels, with contiguous adjacent wedge shaped cartons being oriented in opposite directions, such that the side walls of each adjacent contiguous wedge shaped carton are disposed in coplanar abutting relationship, and wherein the wedge shaped cartons, which are located adjacent said end panels of said outer carton, are disposed such that one corner thereof, defined by the juncture of a base edge and side edge of said top panel of said wedge shaped carton, coincides with one said acute corner portion of said first pair, whereby said wedge shaped cartons are securely held and prevented from shifting within said outer carton thereby reducing the likelihood of damage thereto.

2. A composite packaging system as recited in claim 1 wherein said top panel of said outer carton includes a generally triangular shaped aperture having dimensions slightly less than the dimensions of a top panel of a wedge shaped carton and being in substantial alignment with one of said wedge shaped cartons disposed within said outer carton to permit the viewing of said wedge shaped carton.

3. A composite packaging system as recited in claim 1 wherein four wedge shaped cartons are held within said tubular outer carton.

4. A composite packaging system as recited in claim 1 wherein one of said end panels of said outer carton includes a pair of upper and lower spaced apart intermittent cut lines defining a tear strip to facilitate the opening of said outer carton.

5. A composite packaging system as recited in claim 4 wherein said one end panel is formed of inner and outer end wall members, with said inner end wall member including a cut line defining a tab receiving aperture, and with said intermittent cut lines being formed on said outer end wall member with said upper intermittent cut line further defining a locking tab adapted to interfit with said tab receiving aperture to facilitate the reclosing of said outer carton.

6. A paperboard blank for forming a parallelogram carton adapted to hold a plurality of individual wedge shaped articles, said blank comprising:

(a) a first panel of parallelogram configuration;

(b) a second panel of matching parallelogram configuration;

(c) a generally rectangular side wall panel interposed between said first and second panels, said side wall panel being connected to said first and second panels along parallel fold lines at inner side edges of said first and second panels;

(d) said first and second panels having respective outer edges and first and second end edges;

(e) said first end edges of said first and second panels being non-colinear and intersecting said respective outer edges of said first and second panels at an acute angle, and said first end edges of said first and second panels intersecting said respective inner edges of said first and second panels at an obtuse angle; and (f) said second end edges of said first and second panels being non-colinear and intersecting said respective outer edges of said first and second panels at an obtuse angle, and said second end edges of said first and second panels intersecting said respective inner edges of said first and second panels and an acute angle.

7. The blank of claim 6 further comprising a second side wall panel foldably connected to at least one of said first and second panels at said outer edge thereof.

8. The blank of claim 6 further comprising end wall panels foldably connected to at least one of said first and second end edges of at least one of said first and second panels.

9. The blank of claim 6 further comprising a triangular window formed in at least one of said first and second panels for viewing contents of the carton formed from said blank.

* * * * *